US005148863A

United States Patent [19]

Fouts et al.

[11] Patent Number: 5,148,863

[45] Date of Patent: Sep. 22, 1992

[54] MODULAR COOLER

[75] Inventors: Robert F. Fouts, Rancho Palos Verdes; Craig Fouts, Encinitas; Earl J. Fouts, Rolling Hills, all of Calif.

[73] Assignee: Earl's Supply Co., Long Beach, Calif.

[21] Appl. No.: 821,959

[22] Filed: Jan. 15, 1992

[51] Int. Cl.[5] ..... F28D 1/03

[52] U.S. Cl. ..... 165/149; 165/144; 165/153

[58] Field of Search ..... 165/144, 145, 149, 152, 165/153

[56] References Cited

U.S. PATENT DOCUMENTS

| | | | |
|---|---|---|---|
| 2,044,457 | 6/1936 | Young | 165/144 |
| 2,821,369 | 1/1958 | Hilliard | 165/145 X |
| 2,984,456 | 5/1961 | Young | 165/145 |
| 4,924,938 | 5/1990 | Plaschkes | 165/158 |
| 5,036,911 | 8/1991 | So et al. | 165/153 |

FOREIGN PATENT DOCUMENTS

| | | | |
|---|---|---|---|
| 2855285 | 7/1980 | Fed. Rep. of Germany | 165/153 |
| 3500571 | 11/1985 | Fed. Rep. of Germany | 165/153 |
| 850871 | 10/1960 | United Kingdom | 165/153 |
| 921446 | 3/1963 | United Kingdom | 165/153 |

OTHER PUBLICATIONS

"Automotive Industries" from The Automobile, Nov. 25, 1920 p. 1069 showing the Seppeler truck radiator.

*Primary Examiner*—Allen J. Flanigan

*Attorney, Agent, or Firm*—Poms, Smith, Lande & Rose

[57] ABSTRACT

A modular cooler having a plurality of units which can be interconnected in a leak proof manner yet providing fluid flow therebetween. The cooler can be an oil or transmission fluid cooler and any suitable number of units and any suitable number of units may be stacked. Thus, a single unit can be used in conjunction with like units to provide any desired degree of cooling.

13 Claims, 3 Drawing Sheets

MODULAR COOLER

BACKGROUND OF THE INVENTION

1. Field of the Invention

The invention relates to heat exchangers; and, more particularly, to a modular cooler comprised of a plurality of interconnected units.

2. Description of the Prior Art

Heat exchangers are well known in the art. Certain types are used to cool oil or transmission fluid in vehicles or the like. Depending on the capacity desired, a dealer in such coolers must store in inventory a number of such cooling capacities. There is thus a need for a cooler wherein various capacities may be attended to using only a single unit which can be coupled to one or more like units.

SUMMARY OF THE INVENTION

It is an object of this invention to provide an improved cooler for cooling oil or transmission fluid or the like.

It is further an object of this invention to provide a cooler comprised of a plurality of interconnected modular units.

It is still further an object of this invention to carry out the foregoing object in a leak proof manner with fluid communication between the units.

These and other objects of the invention are preferably accomplished by providing a modular cooler having a plurality of units which can be interconnected in a leak proof manner yet providing fluid flow therebetween. The cooler can be an oil or transmission fluid cooler and any suitable number of units may be stacked. Thus, a single unit can be used in conjunction with like units to provide any desired degree of cooling.

DESCRIPTION OF THE PREFERRED EMBODIMENT

Figure 1:
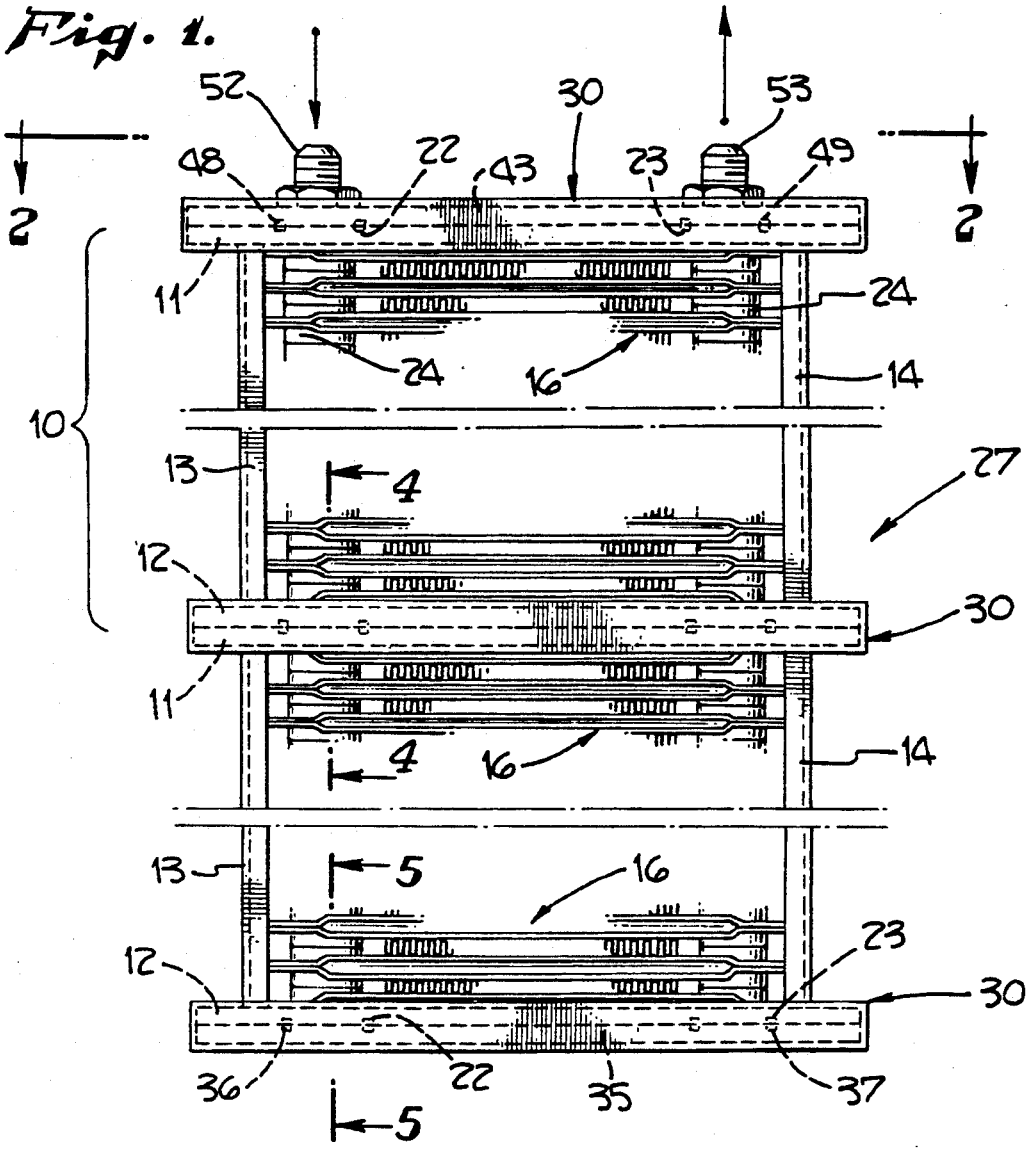
FIG. 1 is an elevational view of a single cooling unit in accordance with the teachings of the invention.
Figure 3:
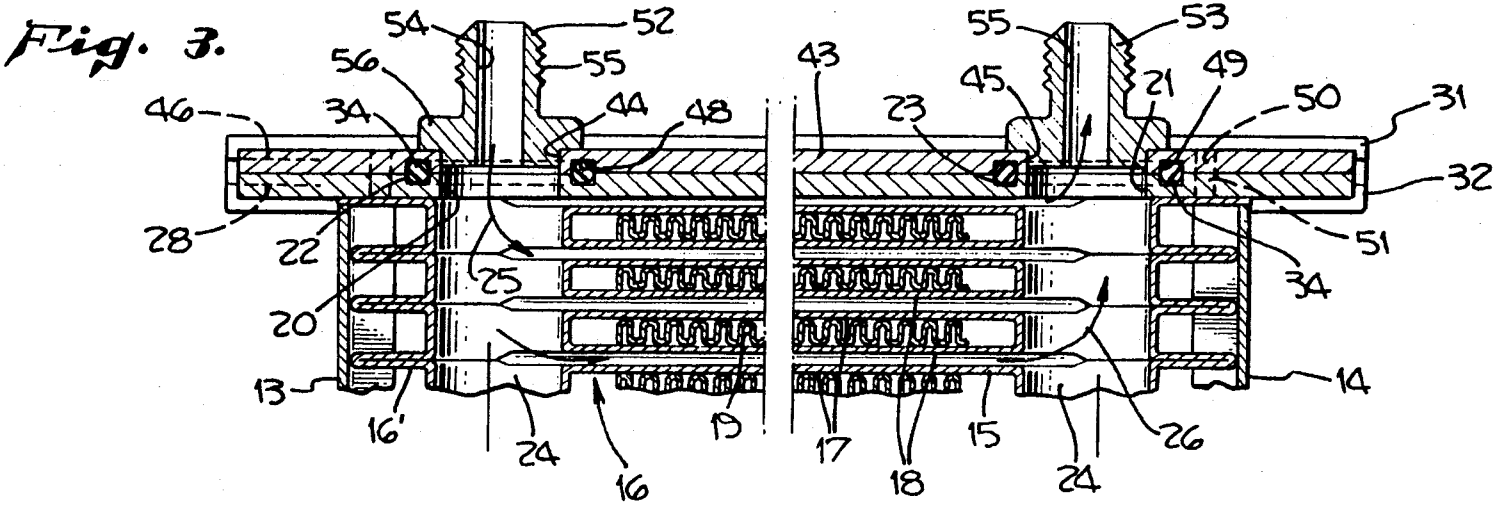
FIG. 3 is a view taken along lines 3—3 of FIG. 2.

Referring now to FIG. 1 of the drawing, a modular cooling unit 10 is shown comprised of an upper plate 11 (FIG. 3) secured to a lower plate 12 (FIG. 6) by a pair of spaced end walls 13, 14 (FIG. 3). A plurality of cooling plates 15 extend between walls 13, 14, secured thereto in any suitable manner. Each plate 15 terminates in apertured end flanges 16' having a mid portion 16 comprised of spaced interconnected upper and lower members 17, 18 providing fluid communication therethrough. A coil 19 separates the cooling plates 15 from each other and upper and lower plates 11, 12.

Each upper and lower plate 11, 12 has a pair of spaced openings 20, 21 (see also FIG. 5) with a groove 22, 23 surrounding each opening 20, 21, respectively (the grooves 23 surrounding opening 21 in lower plate 12 being indicated in dotted lines in FIG. 1).

Figure 2:
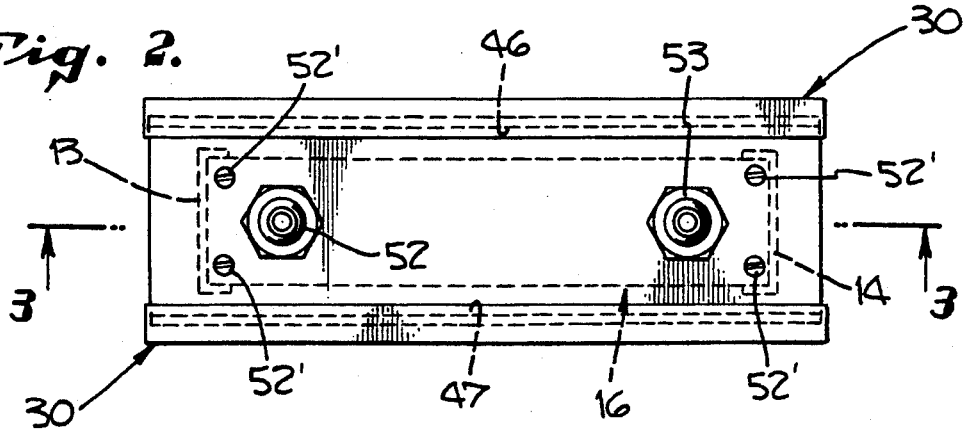
FIG. 2 is a view taken along lines 2—2 of FIG. 1.

The unit 10 may be made of any suitable material, such as metal, coated or uncoated, and assembled in any suitable manner, such as gluing, welding, screws, bolts, etc. As seen in FIG. 2, it can be seen that generally cylindrical hollow tubing portions 24 separate each end flange 16' in each side of midportion 16 and in fluid communication therewith, the tubing sections 24 being axially aligned so that fluid can flow down opening 20 in upper plate 11, through tubing sections 24 and into midportions 16 and thus into the tubing sections 24 on both sides of plates 11, 12 as indicated by arrows 25, 26 in FIG. 3.

Obviously, fluid would flow out of the openings 20, 21 in the lower plate 12 if it were not closed off. However, as particularly contemplated in the present invention, and as shown in FIGS. 1 and 6, a plurality of units 10 can be mounted to provide a modular cooler 27.

Thus, a pair of identical units 10 are shown. Units 10 may be of the same overall height but, as will be discussed, one unit may be higher than the other (having more cooling plates 15, e.g., one unit having eight plates and another unit having thirteen plates).

Figure 6:
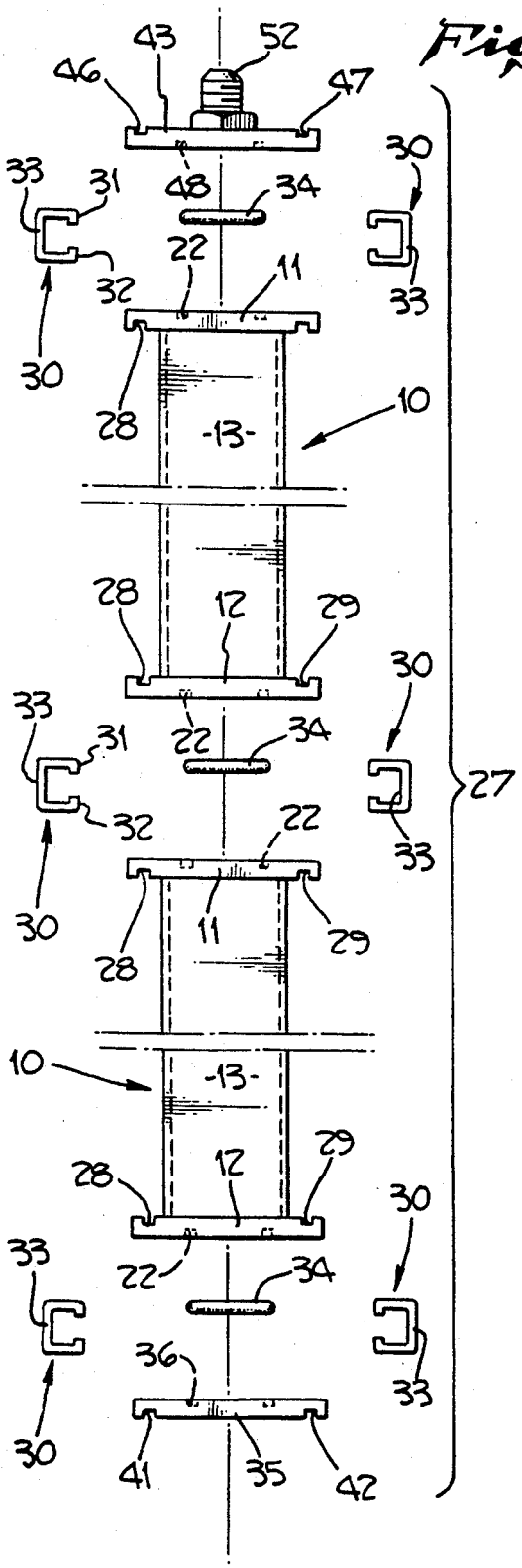
FIG. 6 is an exploded view of the unit of FIG. 1.

As seen in FIG. 6, each plate 12 has a pair of longitudinally extending grooves 28, 29 on one surface thereof on each side of openings 20, 21. The grooves 28, 29 in plate 11 face those in plate 12.

Figure 4:
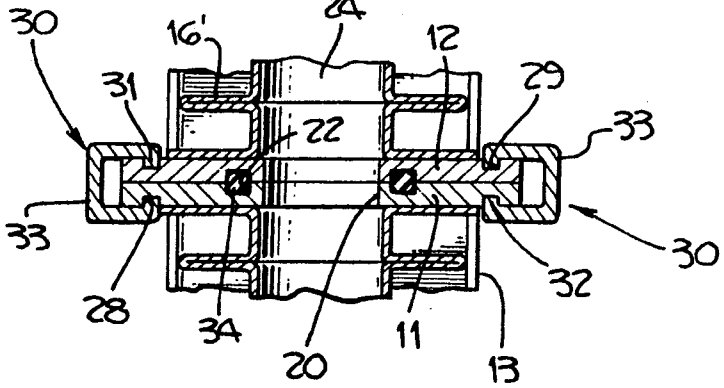

A connecting member 30 is provided in the form of a generally U-shaped bar having inwardly extending flanges 31, 32. The height of wall 33 between flange 31, 32 is generally related to the overall height of the two plates 11, 12 when one plate 11 or 12 abuts against the other plate 11 or 12 as seen in FIG. 4. Connecting member 30 slides over the abutting edges of the mating plates 11, 12 with flanges 31 entering grooves 28, 29 in plate 12 and flanges 32 entering grooves 28, 29 in plate 11. Thus, it is to be understood that more than one connecting member 30 is necessary to assemble the units 10 as seen in FIGS. 1 and 6. Also, resilient O-rings 34 (FIG. 4) are provided which are disposed in grooves 22, 23 in plates 11, 12 prior to assembly of connecting members 30 (see particularly FIG. 7).

Figure 5:
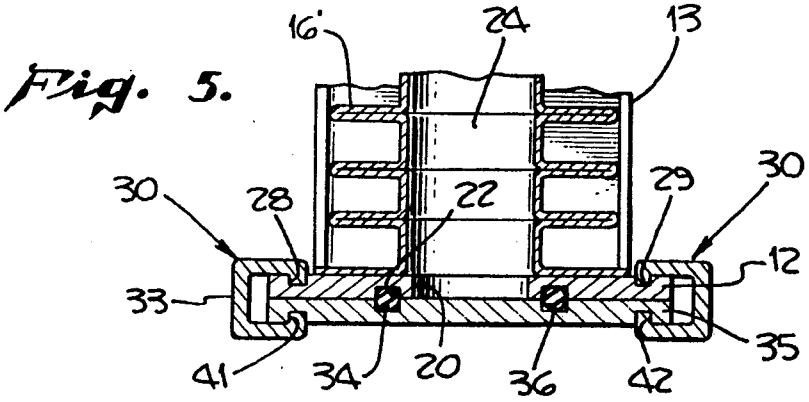
FIGS. 4 and 5 are views taken along lines 4—4 and 5—5 respectively, of FIG. 1.

The bottommost unit 10 is closed off by a closure plate 35 (FIGS. 1, 5 and 6). Plate 35 is of the same overall configuration as plate 12 (e.g., generally rectangular), and has a pair of spaced circular grooves 36, 37 (FIGS. 1 and 5) for receiving O-rings 34 therein when assembled to the lower plate 12 of the bottommost unit 10 (see FIG. 5). If desired, a plurality of holes may be provided in plate 35 aligned with like threaded holes in the plate 12 for receiving therein for securing plate 35 to plate 12. A pair of longitudinally extending grooves 41, 42 (see FIG. 6) are provided on the underside of plate 35 on each edge thereof. As seen in FIG. 5, connecting members 30 are used to interconnect plate 12 of the bottommost unit 10 to closure plate 35, flanges 31, 32 entering grooves 28, 29 and 41, 42, as shown.

A top plate 43 (FIG. 3) is provided for closing off the top wall 11 of the uppermost unit 10. Plate 43 is similarly configured to top wall 11 having a pair of spaced openings 44, 45 adapted to align with openings 20, 21 in top wall 11 when assembled thereto. Plate 43 also has a pair of longitudinally extending grooves 46, 47 (see FIG. 6) along each edge thereof and a pair of circular grooves 48, 49 (see FIG. 3) surrounding each opening 44, 45, respectively. A plurality of holes 50 (see the dotted lines in FIG. 3) may also be provided in plate 43 adapted to align with threaded holes 51 in top plate 11 for receiving screws 52, therein (FIG. 2) when plate 43 is assembled to plate 11. Also, as seen in FIGS. 1, 2 and 3, connecting members 30 are also used to secure plate 43 to top plate 11, the flanges thereof entering grooves 46, 47 in plate 43 with flanges 32 entering grooves 28, 29 in top plate 11.

Figure 7:
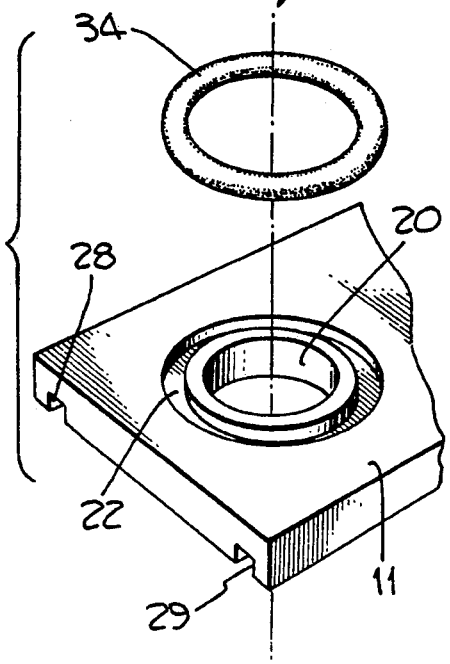
FIG. 7 is an elevational exploded view of a portion of the unit of FIG. 6.

A threaded nipple 52, 53 (FIG. 3) is provided at each opening 44, 45 in plate 43, each nipple 52, 53 having a throughbore 54 and an outer thread 55 with a hexagonally shaped integral nut 56 (FIG. 7). Throughbore 54 is aligned with the respective opening 44, 45 in plate 43 and thus aligned with openings 20, 21 in top wall 11.

The nipples 52, 53 may be one integral piece welded or otherwise secured to plate 43. A suitable fluid conduit (not shown) may be coupled to each nipple 52, 53. When plate 43 is assembled to top wall 11, O-rings 34 (FIG. 7) are disposed in aligned grooves 48, 22 and 49, 23.

Although two units 10 are shown in FIG. 1, obviously a plurality of such units 10 can be modularly stacked and assembled using the screws 52, and connecting members 30. Coolant is flowed through nipple 52, down through the aligned tubing sections 24 and openings 20, 21 and through the midportions 16 back out of nipple 53 as is well known in the cooling art.

The modular system 27 disclosed herein can be used to cool oil, transmission fluid, etc. They can be used anywhere it is necessary to generate a lot of heat, such as in x-ray machines. That is, the fluid passing through the coils of the cooler may be air. The need for carrying a plurality of different cooling units of cooling capacities is substantially reduced since units 10 can be stacked and quickly assembled to obtain any desired coolant capacity.

Figure 8:
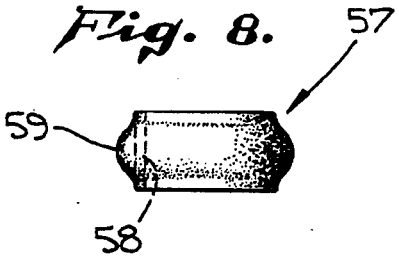
FIG. 8 is an elevational view of a modified seal in accordance with the teachings of the invention.
Figure 9:
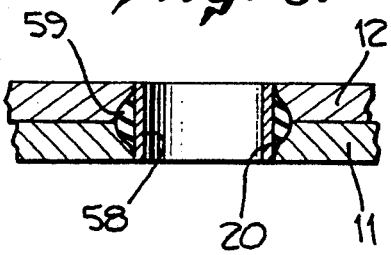
FIG. 9 is an elevational view of a pair of abutting plates having the seal of FIG. 8 sealing the plates.

Although O-rings and mating grooves have been indicated as sealing means between the units 10, obviously other means can be used. For example, as seen in FIGS. 8 and 9, a seal 57 is shown having a main generally cylindrical body portion 58 with an outer resilient protuberance 59. As seen in FIG. 9, seal 57 can be provided in aligned openings 20 between the upper and lower plates 11, 12 with protuberance 59 entering the space between the plates 11, 12, resiliently filling the same, and providing a seal. In this case, the O-rings and grooves therefor are not necessary.

Also, although longitudinal grooves and U-shaped connecting members have been disclosed, obviously nuts and bolts, rivets, adhesives, clamps, etc. may be used to quickly and easily secure the plates together. The connecting members have been disclosed as preferably extending the full length of the various plates; obviously they may be shorter and not necessarily full length.

Any suitable size of unit 10 may be used. The cooling plates are generally referred to as tubes and a 10 or 15 tube cooler unit may be used.

I claim:

1. A modular cooler comprised of a plurality of interconnected units, each of said units comprising:

an upper plate and a lower plate;

a pair of spaced end walls secured to said upper and lower plates;

a plurality of spaced cooling plates mounted below said upper plate, above said lower plate and between said end walls and secured thereto, each of said cooling plates having a hollow midbody portion with integral flanges at each end of said midbody portion, with apertures therethrough, said apertures in said flanges being in fluid communication with the interior of said midbody portion;

a pair of spaced openings in each of said upper and lower plates, one of said openings being on one side of said upper and lower plates and the other of said openings being on the other side of one of said upper and lower plates, the openings on said one side of said upper plate being aligned with the opening on said one side of said lower plate and with said apertures extending through one side of said flanges, and the opening on the other side of said upper plate being aligned with the opening on the other side of said lower plate and with said apertures extending through the other side of said flanges whereby fluid communication is provided from said one of said openings through said aligned apertures, through said midbody portions and out said other of said openings, one of said units being secured in a fluid-tight manner to another of said units with the lower plate of one of said units abutting against the upper plate of another of said units, and a closure plate closing off the lower plate of said another of said units in a fluid tight manner.

2. In the cooler of claim 1 including a threaded nipple associated with each opening in said upper plate having throughbores in fluid communication with said openings.

3. In the cooler of claim 1 which said nipples are mounted to a nipple plate secured to said top plate, said nipple plate having a pair of spaced openings aligned with both said openings in said top wall and said throughbore through said nipples.

4. In the cooler of claim 3 wherein said nipple plate is secured to said top plate in a fluid tight manner.

5. In the cooler of claim 4 wherein said nipple plate has a circular groove therein surrounding each opening through said nipple plate with a resilient 0-ring disposed in each groove.

6. In the cooler of claim 4 including a rigid cylinder extending through aligned openings in said nipple plate and said top wall, and a resilient annular member on said cylinder filling the space between abutting surfaces of said nipple plate and said top plate surrounding said aligned openings.

7. In the cooler of claim 3 wherein said nipple plate is removably secured to said top plate.

8. In the cooler of claim 7 wherein said nipple plate has at least one groove along one edge of the upper surface thereof and at least one groove along another edge of the upper surface thereof generally parallel to said first mentioned groove, said top plate having at least one groove along one edge of the lower surface thereof and at least one groove along another edge of the lower surface thereof generally parallel to said first mentioned groove on said top plate, and a removable bar generally U-shaped in cross section having a back wall and integral spaced side walls terminating in inwardly extending ears, said ears being mounted in said grooves removably securing said nipple plate to said top plate.

9. In the cooler of claim 8 wherein like spaced grooves are provided in the underside of said bottom plate whereby one of said units is removably connected to the other of said units by said removable bars engaging grooves in the lower plate of one of said units and the upper plate of another of said units.

10. In the cooler of claim 9 wherein closure plate is removably connected to the lower plate of said another of said units by like spaced grooves provided in the underside of said closure plate whereby the lower of plate of said another of said units is removably connected to said closure plate by said removable bars engaging grooves in the lower plate of said another of said units and the grooves in the underside of said closure plate.

11. In the cooler of claim 1 wherein said lower plate is secured to said closure plate in a fluid tight manner.

12. In the cooler of claim 11 wherein said lower plate has a circular groove therein on the underside thereof surrounding each opening through said lower plate and said closure plate also has a circular groove aligned with each circular groove in said lower plate with a resilient 0-ring disposed in aligned grooves in said lower plate and said closure plate.

13. In a modular cooler comprised of a plurality of interconnected units each of said units comprising:

an essentially flat and planar upper plate and an essentially flat and planar lower plate;

a pair of spaced end walls secured to said upper and lower plates;

a plurality of spaced cooling plates mounted below said upper plate, above said lower plate and between said end walls and secured thereto, each of said cooling plates having a hollow midbody portion with integral flanges at each end of said midbody portion with apertures therethrough, said apertures in said flanges being in fluid communication with the interior of said midbody portion;

said plurality of interconnected units being interconnected by stacking them in abutting relationship with the upper plate of one unit abutting the lower plate of an adjacent unit; and a pair of spaced openings in each of said upper and lower plates, one of said openings being on one side of said upper and lower plates and the other of said openings being on the other side of one of said upper and lower plates, the opening on said one side of said upper plate being aligned with the opening on said one side of said lower plate and with said apertures extending through one side of said flanges, and the opening on the other side of said upper plate being aligned with the opening on the other side of said lower plate and with said apertures extending through the other side of said flanges whereby fluid communication is provided from said one of said openings through said aligned apertures, through said midbody portions and out of said other of said openings.

* * * * *